United States Patent [19]

Aso

[11] Patent Number: 4,920,238

[45] Date of Patent: Apr. 24, 1990

[54] SELF-CENTERING SWITCH

[75] Inventor: Hideo Aso, Tokyo, Japan

[73] Assignee: Seikosha Co., Ltd., Japan

[21] Appl. No.: 265,687

[22] Filed: Nov. 1, 1988

[30] Foreign Application Priority Data

Nov. 2, 1987 [JP] Japan ..... 62-168088[U]

[51] Int. Cl.[5] ..... H01H 21/24

[52] U.S. Cl. ..... 200/6 R; /6 BB; /557; /559; /339

[58] Field of Search ..... 200/6 R, 6 B, 6 BA, 200/6 BB, 6 C, 17 R, 61.27, 61.54, 63 R–66, 153 K, 155 R, 156, 292, 339, 61.85, 533, 557–559

[56] References Cited

U.S. PATENT DOCUMENTS

| | | | |
|---|---|---|---|
| 2,695,343 | 11/1954 | Howard | 200/6 C X |
| 2,708,227 | 5/1955 | Collura | 200/65 X |
| 3,299,224 | 1/1967 | De Lorme et al. | 200/6 B |
| 3,408,463 | 10/1968 | Wanlass | 200/6 R |
| 3,501,607 | 3/1970 | Tanaka | 200/6 BB X |
| 3,527,913 | 9/1970 | Gionet | 200/6 BB X |
| 3,529,109 | 9/1970 | Cross | 200/6 R |
| 3,882,293 | 5/1975 | Naples et al. | 200/65 X |
| 4,103,126 | 7/1978 | DeNigris et al. | 200/557 |
| 4,599,501 | 7/1986 | Migrin | 200/156 |
| 4,678,871 | 7/1987 | Wong | 200/6 R X |

*Primary Examiner*—J. R. Scott

*Attorney, Agent, or Firm*—Bruce L Adams; Van C. Wilks

[57] ABSTRACT

A self-centering switch is provided with a rocker bar pivotally mounted to move between a neutral and an actuated position. A contact element having a pair of contact bearing resilient arms is mounted at the pivot axis of the rocker bar. The resilient arms are biased against the rocker bar and act to return the bar to its neutral position. The contact element may be connected to a control circuit formed on a circuit board and having one or more fixed contacts alternately engageable by the contacts on the resilient arms.

5 Claims, 3 Drawing Sheets

SELF-CENTERING SWITCH

FIELD OF THE INVENTION

The present invention relates to a switch, more particularly, to a self-centering switch switch used, for example, to adjust time indicated by a digital timepiece.

BACKGROUND OF THE INVENTION

On some conventional switches used for adjusting time indicated by digital timepiece, a forward button and a backward button are mounted independently. Other known switches used for the same purpose have a seesaw switch to which a crown is connected. When indicated time is adjusted, the crown is pivoted in one direction or the other.

The conventional switch having independent forward and backward buttons operates poorly. Further, the two buttons must be juxtaposed, thus occupying considerable space so that the switch is not suitable for miniaturization. In the switch having the crown, if the crown is reduced in size to make the timepiece thinner, then it becomes more difficult to operate the crown.

It is an object of the utility model to provide an inexpensive switch which can be miniaturized, can be made thin, and is easy to operate.

SUMMARY OF THE INVENTION

The present invention is characterized in that for example a watch casing is provided with an opening at a lateral wall there of and a support pole is formed adjacent to said opening inside said casing. A substantially T-shaped operable member is pivotally held on the support pole and comprises a rocker bar portion located in said opening and a leg portion extending inward from substantially the center of said bar portion, said leg portion being rotatably held on said support pole. A circuit board is mounted in said casing and positioned in parallel to said casing. A contact element is provided which has a base portion connected to one side of said circuit board and a switch element bent substantially normal to said base portion and extending along an inside surface of said rocker bar portion. Contacts are provided on an end surface with said circuit board and with which the switch element makes and breaks contact when depressed by movement of the rocker bar portion.

BRIEF DESCRIPTION OF THE PREFERRED EMBODIMENTS

One embodiment of the present invention is hereinafter described with reference to the drawings.

Figure 1:
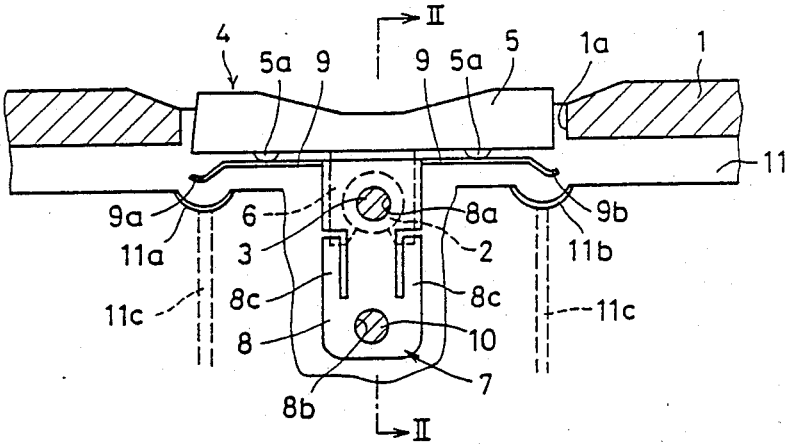
FIG. 1 is a plan view partially in cross section of a switch according to the present invention.
Figure 2:
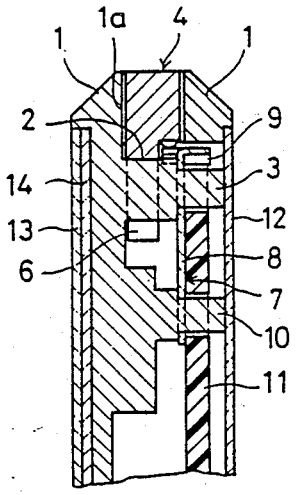
FIG. 2 is a cross-sectional view taken on line II—II of FIG. 1.

Referring to FIGS. 1 and 2, a casing 1 has an opening 1*a* at a lateral wall thereof. A cylindrical support pole 2 is formed integrally with the casing 1 adjacent to the opening 1*a*. A protrusion 3 is provided on the pole 2. An operable member 4 is pivotally mounted on the pole 2, as described below. The operable member 4 comprises a bar portion 5 and a leg portion 6 extending inwardly of the casing 1 from substantially the center of the bar portion 5, and is shaped like the letter "T". The bar portion 5 is situated inside the opening 1*a* so as to be depressed. Protrusions 5*a* which come into contact with a contact member 7 are formed on the surface of the bar portion 5 which faces the leg portion 6. The leg portion 6 is bifurcated so as to be resiliently deformable, and it is formed resiliently and is rotatable around the outer surface of the support pole 2. During assembly, the operable member 4 is inserted from the opening 1*a*, and the leg portion 6 is resiliently deformed around and grips the circumference of the support pole. Then, the leg portion 6 is rotatably and resiliently mounted on the outer surface of the support pole 2. The contact member 7 comprises a base portion 8 and a switch element 9 bent normal to the base portion 8. The base portion 8 is provided with holes 8*a* and 8*b*. The protrusion 3 and a similar protrusion 10 is fitted in the holes 8*a* and 8*b* respectively so as to place the contact member 7 in position. The base portion 8 is partially cut away, and has a bent portion 8*c*. The base portion 8 is in contact with a circuit (not shown) formed on a circuit board 11. The switch element 9 has a pair of resiliently flexible arms that extend along an inside surface of the bar portion 5. The switch element 9 bears against the protrusion 5*a* and the resilient arms can resiliently deform or flux about the point at which it is coupled to the base portion 8. Both ends 9*a* and 9*b* of the arms of the switch element 9 define movable contacts which can make and break contact with the fixed contacts 11*a* and 11*b* respectively which are connected with a wiring pattern 11*c* shown in FIG. 1. Wiring patterns 11*c* are connected to the circuit (not shown) on the circuit board 11. Reference numerals 12 and 13 (FIG. 2) depict decorative plates, and reference numeral 14 depicts a steel plate which reinforces the casing 1.

Figure 3:
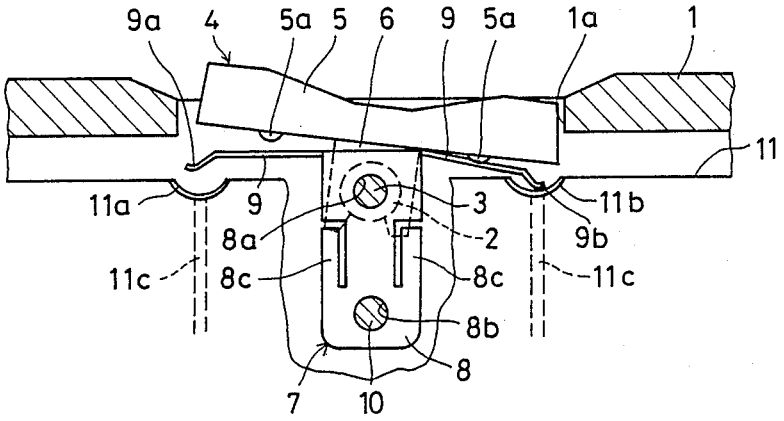
FIG. 3 is a plan view in cross section of the switch shown in FIG. 1 and showing one operating condition of the switch.
Figure 4:
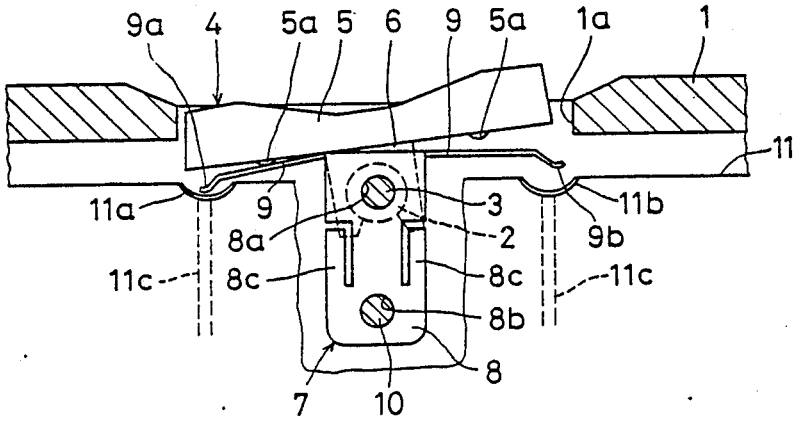
FIG. 4 is a plan view in cross section of the switch shown in FIG. 1 and showing another operating condition of the switch.

The operation is next described, particularly in connection with FIGS. 1, 3 and 4. Usually, the operable member 4 is placed in its neutral position by the switch element 9 as shown in FIG. 1. In this state, the switch element 9 is spaced from the contacts 11*a* and 11*b*. When the operable member 4 is depressed so as to pivot clockwise as shown in FIG. 3, it pivots or rotates about the pole 2. Then, one of the arms of the switch element 9 is pushed by the protrusion 5*a* and resiliently deformed. This brings the movable contact 9*b* into engagement with the fixed contact 11*b*, closing the switch. When the depressing force is removed, the switch element 9 is resiliently restored to the condition shown in FIG. 1, thus opening the switch. If the operable member 4 is depressed so as to pivot counterclockwise, as shown in FIG. 4, then the other arm of the switch element 9 similarly deforms resiliently, causing the movable contact 9*a* to bear against the fixed contact 11*a*. As a result, the switch is closed.

As described above in detail, the present utility model provides an inexpensive switch which is simple in structure, shows excellent operability, and takes up only small space to install. Further, it is easy to assemble, because the operable member can be mounted finally. In this way, the novel switch yields quite excellent practical advantages.

What is claimed is:

1. A self-centering switch comprising: a circuit board having a pair of spaced-apart fixed electric contacts mounted on a surface thereof; a stationary support rod disposed between the pair of fixed contacts; a pivotable rocker bar having a bar portion and a leg portion depending from the bar portion, the leg portion comprising a pair of resiliently spreadable fingers resiliently engageable with the support rod to thereby pivotally mount the rocker bar for pivotal movement in opposite directions about the support rod; and an electrical contact member having a pair of resiliently flexible arms each carrying a movable electrical contact and being electrically and structurally connected to said circuit board, the pair of flexible arms being positioned so that the movable contacts are opposite respective ones of the fixed contacts and the flexible arms resiliently engaging with the bar portion of the rocker bar to normally resiliently bias the rocker bar to a neutral position on the support rod in which the movable contacts are spaced from the respective fixed contacts so that pivotal movement of the rocker bar in one direction to one actuated position causes resilient flexure of one arm to move the movable contact carried thereby into electrical contact with one fixed contact and pivotal movement of the rocker bar in the other direction to another actuated position causes resilient flexure of the other arm to move the movable contact carried thereby into electrical contact with the other fixed contact, the rocker bar being returned from the actuated positions to the neutral position by the resilient bias of the arms.

2. The self-centering switch of claim 1, in which said contact member comprises a conductive plate mounted on said support rod.

3. The self-centering switch of claim 2, in which said pair of arms are integral with said conductive plate.

4. The self-centering switch of claim 3, in which each of said arms is formed from a portion of said conductive plate bent relative to said conductive plate to a position substantially orthogonal to the plane of said conductive plate.

5. The self-centering switch of claim 1, in which said rocker bar is provided with a longitudinally extending actuator surface, and said pair of arms extend along said rocker bar substantially adjacent and parallel to said actuator surface.

* * * * *